United States Patent [19]

Logie et al.

[11] Patent Number: 4,504,810

[45] Date of Patent: Mar. 12, 1985

[54] ELECTROMAGNETIC DEVICES

[75] Inventors: Frank M. Logie, London; Ronald Phillips, Northolt, both of England

[73] Assignee: Lucas Industries Public Limited Company, Birmingham, England

[21] Appl. No.: 407,880

[22] Filed: Aug. 13, 1982

[30] Foreign Application Priority Data

Aug. 22, 1981 [GB] United Kingdom ..... 8125713

[51] Int. Cl.[3] ..... H01F 7/08

[52] U.S. Cl. ..... 335/261; 335/279; 310/27

[58] Field of Search ..... 335/261, 126, 262, 266, 335/268, 274; 310/27

[56] References Cited

U.S. PATENT DOCUMENTS

| | | | |
|---|---|---|---|
| 4,197,518 | 4/1980 | Seilly et al. | 335/274 X |
| 4,238,698 | 12/1980 | Seilly et al. | 310/27 |
| 4,238,699 | 12/1980 | Seilly | 335/266 X |
| 4,326,139 | 4/1982 | Mowbray | 310/27 X |

*Primary Examiner*—George Harris

[57] ABSTRACT

An electromagnetic device includes a stator having circumferential ribs which define grooves locating windings. An annular armature has internal ribs which extend into the grooves and the armature is divided along its length into at least two parts to enable assembly about the stator. The armature parts are secured at one end to an output member and at the other end are located by the wall of a surrounding body or a part carried thereby.

7 Claims, 2 Drawing Figures

ELECTROMAGNETIC DEVICES

This invention relates to an electromagnetic device of the kind comprising a stator structure which defines a plurality of axially spaced circumferentially extending pole pieces, the stator structure including windings which when supplied with electric current cause adjacent ones of said pole pieces to assume opposite magnetic polarity and an armature which surrounds the stator structure, the armature being of annular form and having on its internal peripheral surface pole pieces complementary to the pole pieces on the stator structure.

The armature can be passed over the stator structure of a device as set forth above only if the air gaps between the pole pieces of the armature and stator structure extend parallel to the longitudinal axis of the stator structure. If it is desired that the air gaps should not extend as aforesaid i.e. that the pole pieces on the stator structure and armature should overlap, then unless the device is of stepped form, the armature cannot be assembled about the stator structure because the pole pieces on the armature and stator structure will interfere with each other.

It has been suggested that the armature can be divided axially into two or more parts which are then assembled about the stator structure and located together.

According to the invention an electromagnetic device comprising a stator structure, a plurality of axially spaced circumferentially extending pole pieces, windings carried by the stator structure, said windings when supplied with electric current causing adjacent ones of said pole pieces to assume opposite magnetic polarity, an armature surrounding the stator structure, the armature being of annular form and having on its internal peripheral surface pole pieces complementary to the pole pieces on the stator structure, said armature being divided axially into at least two parts to enable it to be assembled about the stator structure, an output member coupled to one end of the armature, and a washer secured to the output member, said washer acting to maintain the parts of the armature against inward movement.

Two devices of this type will now be described with reference to the accompanying drawings.

Figure 1:
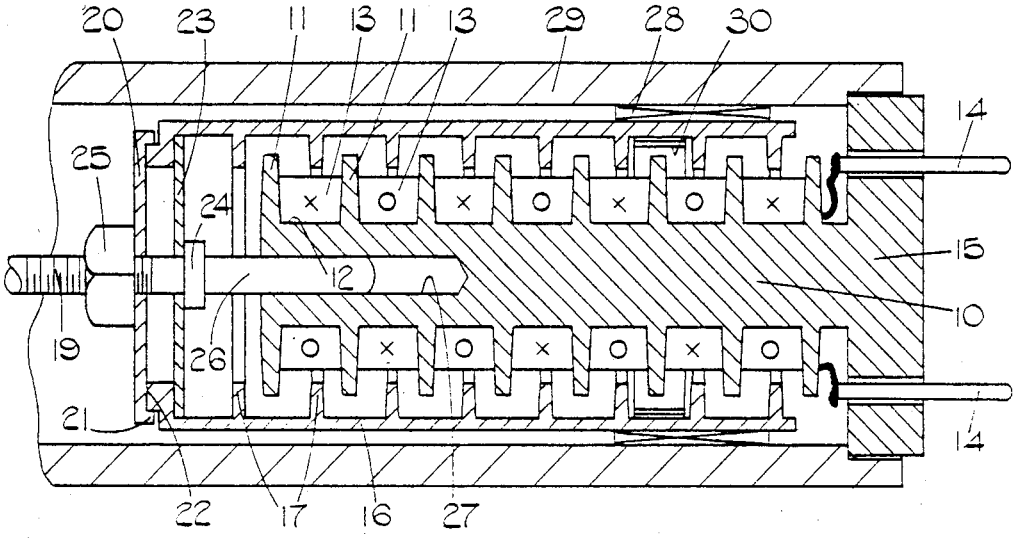
Figure 2:
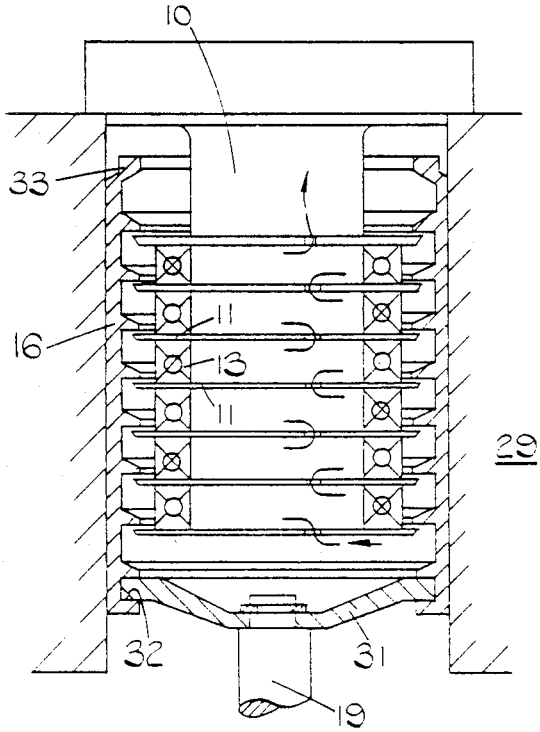

FIGS. 1 and 2 are both sectional side elevations of preferred embodiments.

Referring to FIG. 1 of the drawings the device comprises a stator structure referenced 10 which is formed from magnetizable material and which has a plurality of circumferential radial ribs 11 on its peripheral surface. Each pair of adjacent ribs defines a groove 12 and located in the grooves are windings 13 respectively which are for example, connected in series to a pair of supply terminals 14 carried by and electrically insulated from, an enlarged portion 15 of the stator. The windings 13 are interconnected such that the direction of electric current flow in each winding is opposite to that in the adjacent winding and the result is that adjacent ribs 11 when electric current is passed through the windings, will assume opposite magnetic polarity.

Surrounding the stator structure is an annular armature 16. This is provided with ribs 17 on its internal peripheral surface and it will be noted that the ribs 17 extend into the grooves 12. The armature is formed from magnetizable material which is initially constructed from an annulus of material, and in order that it can be assembled about the stator structure, it is divided lengthwise into two or more parts by means of axially extending slits. In this manner the armature can be assembled about the stator structure so that it can assume the position shown in the drawing. In dividing the armature, material is lost in the slitting process.

The two parts of the armature are secured to an output member 19. For this purpose the output member carries a washer 20 which has a peripheral flange 21 which defines an internal surface against which stepped inwardly directed flanges 22 formed on the adjacent end portions of the parts of the armature, can be engaged. The flanges are located by means of a spacer washer 23 which is located against a pin or collar 24 extending through or mounted on an inwardly extending extension 26 of the output member 19. The output member 19 carries a nut 25 engageable with the washer 20 so that the two washers can be tightened towards each other thereby clamping the end portions of the armature. Conveniently the extension is slidable within a bore 27 formed in the stator structure. The washer 23 also acts to maintain the armature parts in the correct radial relationship.

In order to provide radial location of the portions of the armature remote from the output member 19, a spacer ring or rings 30 is located within the armature and this acts to hold the armature parts against an annular bearing 28 located within a housing 29. The ring 30 is formed from non-magnetic material to minimize flux leakage and the housing is recessed to receive the enlarged portion of the stator.

In use, when electric current is supplied to the winding the pole pieces defined by the adjacent ribs 11 assume opposite magnetic polarity and the ribs 17 of the armature will experience a magnetic force tending to reduce the size of the air gaps between the ribs 17 and the ribs 11. The armature will therefore move axially, the extent of such movement being determined by the abutment of the ribs on the armature and stator structure. The direction of movement of the armature depends upon the axial position of the ribs 17 in the grooves 12 prior to the energisation of the windings and it is essential that the ribs should be off centre in the direction of movement which is required. The axial slots which exists between adjacent parts of the armature have little influence upon the operation of the device.

The armature instead of being formed by slitting a continuous annular member as described may be formed by building up the armature to annular form from a number of segments.

Referring now to FIG. 2 of the drawings, identical reference numerals are utilized wherever possible. In the example shown in FIG. 2, the armature 16 engages throughout its axial length, with the internal peripheral surface of the housing 29 so that it is the housing 29 which provides the location for the parts of the armature. The output member 19 is secured within an annular dished spacer washer 31 the rim of which locates within a circumferential groove 32 formed in the internal peripheral surface of the parts of the armature. The washer 31 is located within the grooves 32 before the armature and stator are inserted into the body 29. Moreover, in order to retain the parts of the armature in rough assembled relationship prior to locating the armature within the body, a wire clip 33 may be located about the armature within a suitable groove. The material forming the clip 33 may be formed from any suitable material.

We claim:

1. An electromagnetic device comprising a stator structure, a plurality of axially spaced circumferentially extending pole pieces, windings carried by the stator structure, said windings when supplied with electric current causing adjacent ones of said pole pieces to assume opposite magnetic polarity, an armature surrounding the stator structure, the armature being of annular form and having on its interval peripheral surface pole pieces complementary to the pole pieces on the stator structure, the pole pieces of the armature and stator structures overlapping each other in the radial direction, said armature being divided axially into at least two parts to enable it to be assembled about the stator structure, an output member coupled to one end of the armature, and a washer secured to the output member, said washer acting to maintain the parts of the armature against inward movement.

2. A device according to claim 1 in which said washer locates against the inner peripheral surfaces of the armature.

3. A device according to claim 2 including a further washer, a peripheral flange on the further washer, inwardly directed flanges on the parts of the armature respectively, said inwardly directed flanges being engaged on one side by said further washer and on the other side by said first mentioned washer, the peripheral flange being located about said inwardly directed flanges and means for retaining said washers in engagement with said inwardly directed flanges.

4. A device according to claim 3 in which said retaining means comprises a pin or collar on an extended portion of the output member and a nut in screw-threaded engagement with a screw threaded portion of the output member, said washers being located between said nut and said pin or collar.

5. A device according to claim 4, including a spacer ring disposed adjacent the opposite end of the armature, said spacer ring being disposed within the armature to maintain the parts of the armature against inward movement, a housing surrounding the armature in spaced relationship and an annular bearing within the housing, said annular bearing engaging the exterior surfaces of said armature parts, said spacer ring acting to maintain said armature parts in engagement with said bearing.

6. A device according to claim 5 in which said stator has an enlarged portion, said housing being recessed to receive said enlarged portion.

7. A device according to claim 2 in which said washer is located within a groove formed in the internal surfaces of said parts of the armature, the device including a housing which surrounds said parts of the armature and which acts to support said parts for axial movement.

* * * * *